US005570959A

United States Patent [19]

Moriwaki et al.

[11] Patent Number: 5,570,959

[45] Date of Patent: Nov. 5, 1996

[54] METHOD AND SYSTEM FOR PRINTING GAP ADJUSTMENT

[75] Inventors: Hisao Moriwaki; Kouichi Uozumi; Hiroshi Fujimoto; Daigo Uchikoshi; Mitsunori Hiraishi; Kazuhiro Tamada; Shingo Ashida; Tsutomu Nagatomi; Yoshito Fukata, all of Hyogo, Japan

[73] Assignee: Fujitsu Limited, Kawasaki, Japan

[21] Appl. No.: 525,346

[22] Filed: Sep. 7, 1995

[30] Foreign Application Priority Data

Oct. 28, 1994 [JP] Japan ..... 6-265271
Oct. 28, 1994 [JP] Japan ..... 6-265778

[51] Int. Cl.[6] ..... B41J 25/308

[52] U.S. Cl. ..... 400/56; 400/58; 400/59

[58] Field of Search ..... 400/55, 56, 57, 400/58, 59

[56] References Cited

U.S. PATENT DOCUMENTS 4,990,004 2/1991 Kawahaia et al. ..... 400/56
5,360,276 11/1994 Petermann ..... 400/56
5,468,076 11/1995 Hitano et al. ..... 400/56
5,474,392 12/1995 Matsuoka ..... 400/56

*Primary Examiner*—Ren Yan
*Attorney, Agent, or Firm*—Armstrong, Westerman, Hattori, McLeland, & Naughton

[57] ABSTRACT

In a printing machine such as an impact printer, the printing gap between a print head and a platen is appropriately adjusted to cope with a variety of paper sheets. For adjusting the printing gap, the platen (or print head) is moved toward the print head (or platen) to press a paper sheet and then the platen (or print head) is moved to an origin position. Thereafter, the platen (or print head) is moved closer to the print head (or platen) by an appropriate pressing distance obtained by subtracting an appropriate value for the printing gap from the distance between the pressing position and the origin position.

24 Claims, 15 Drawing Sheets

ADJUSTMENT START INSTRUCTION SIGNAL

PLATEN MOVEMENT DISTANCE (TIME)

PLATEN STOP REVERSE ROTATION TIMING

PLATEN STOP RESTART OF FORWARD ROTATION TIMING (ORIGIN POSITION SIGNAL DETECTION)
A1
MOVEMENT TO HEAD
PLATEN IN STOPPED STATE
t0
R
NO
MOVEMENT IN NO REVERSE DIRECTION
t1
R-n2
N1
MOVEMENT TO HEAD
t2
END
t3

METHOD AND SYSTEM FOR PRINTING GAP ADJUSTMENT

BACKGROUND OF THE INVENTION (1) Field of the Invention

The present invention relates to a method and system for printing gap adjustment and more particularly to a technique for appropriately adjusting a gap between a print head and a platen in a printing machine such as an impact printer.

(2) Description of the Prior Art

In a printing machine such as an impact printer, a paper sheet is held between a print head and a platen and a pin called "dot pin" strikes the paper sheet from the print head to perform printing in a desirable way. If the gap between the print head and the platen is too narrow in such a printing machine, the pin is more likely to be bent or snapped by the pin striking force and ribbon and paper are also likely to be jammed. On the other hand, too broad a printing gap might cause images to be faint or result in a snap of the pin if strokes exceed a predetermined value. To prevent bending of the pin and an occurrence of ribbon jam or paper jam and to improve print quality, it is necessary to appropriately adjust the printing gap between the print head and platen in accordance with the thickness of a paper sheet to be used.

One known printing gap adjustment system has the structure shown in FIG. 15. In a printing gap adjustment system 100 shown in FIG. 15, there are provided a print head 101 and a platen 102 in opposing relationship. A support shaft 102*a* of the platen 102 is energized by the spring force of a coil spring 103 in such a direction to separate the shaft 102*a* from the print head 101 and received by an eccentric cam 104. The eccentric cam 104 is rotated via a link 107 by rotating a lever 105 through a predetermined angle on a supporting point 106, so that the printing gap between the print head 101 and the platen 102 is adjusted. The amount of gap adjustment is checked by reading a gap scale 108 provided on the print head 101. The gap scale 108 is calibrated based on the number of paper sheets overlapped.

SUMMARY OF THE INVENTION

The calibration of such a gap scale cannot be unitarily carried out according to paper thickness, since paper sheets to be used vary in thickness (e.g., a basic weight of 30 to 130 $kg/m^2$) and some printing media such as slips widely used by couriers are made up of a plurality of number of overlapped sheets having different thickness.

In fact, judgment of paper thickness is totally dependent on the operator's experience and gap adjustment is done with a scale set according to the paper thickness judged by the operator. This makes it extremely difficult to achieve accurate gap adjustment and therefore the above-noted problems such as a snap of the pin and an occurrence of jam remain unsolved.

To prevent a snap of the pin and an occurrence of jam, test printing is often carried out for checking whether appropriate gap adjustment has been performed. As has been noted, it is very difficult to adjust the printing gap to be an optimum value in one operation with a gap scale set based on the operator's experience, and therefore, the gap adjustment and test printing need to be repeated several times, which involves considerable time and troublesome work.

The invention has been made to overcome the foregoing problems and one of the objects of the invention is therefore to provide a method and system for printing gap adjustment which enable appropriate printing adjustment for a variety of types of paper sheets to contribute to the reduction of printing troubles and to an improvement in the reliability of a printer.

The above object can be achieved by a printing gap adjustment method according to the invention for adjusting the printing gap between a print head and a platen that are so disposed as to move closer to or away from each other with a paper sheet interposed therebetween, the method comprising the steps of:

moving the print head or the platen to press the paper sheet;

moving the print head or the platen to an origin position, being far away from the paper sheet; and moving the print head or platen to an appropriate position where the printing gap has an appropriate value.

In the above printing gap adjustment method, the print head or the platen is first moved to press a paper sheet held between the print head and the platen. Then, the print head and the platen are separated from each other and either of them is moved to an origin position where the movement is reversed. So, the print head or the platen is moved toward the other until it reaches an appropriate position where the printing gap has an appropriate value. In such an operation, backlash is generated by reversing the movement of the driven part at the origin position. This backlash has a opposite direction and equivalent degree with respect to the backlash of the compliant part which is generated when the movement of the driven part is reversed at the pressing position. Therefore, the printing gap between the print head and the platen can be adjusted to be an appropriate value in a condition where the backlash generated at the pressing position is offset by the backlash generated at the origin position, which prevents further movement of the print head or the platen from the appropriate position in the separating direction. In this way, printing gap adjustment is automatically performed so that gap adjustment by troublesome manual work and test printing for checking whether adjustment has been appropriately done are no longer necessary.

On the contrary to the invention, if the print head or the platen is directly moved from the pressing position to the appropriate position, backlash occurs at the pressing position due to reversing the movement of the driven part and the print head or the platen further moves in the separating direction within the range of the backlash once the print head or the platen has been moved in the separating direction, with the result that appropriate printing gap adjustment cannot be performed.

In the invention, the appropriate position is preferably defined as follows: The distance between the pressing position where the paper sheet is pressed by the print head and the platen and the origin position is first detected; the appropriate value is subtracted from the detected distance to obtain an appropriate pressing distance which is the distance between the origin position and the appropriate position; and the print head or the platen is moved from the origin position by the appropriate pressing distance to be positioned at the appropriate position.

For obtaining the appropriate pressing distance, the following way is particularly preferable in view of an improvement in adjustment accuracy: Pressing of the paper sheet by the print head and the platen and the separation to the origin position are repeated a plurality of number of times and the distance between the pressing position where the paper sheet is pressed by the print head and the platen and the origin position is detected a plurality of number of times. Based on the average of a plurality of detected distance values, the appropriate pressing distance is calculated. Further, it is preferable that the paper sheet be pressed by the print head and the platen at a position where no perforation exists. This prevents errors in the detection of paper thickness, leading to more accurate printing gap adjustment.

According to the invention, there is provided a printing gap adjustment system for adjusting the printing gap between a print head and a platen that are so disposed as to move closer to or away from each other with a paper sheet interposed therebetween, the system comprising:

(a) an approach/separation mechanism for moving either the platen or the print head closer to or away from the other so that the relative positions of the platen and the print head are adjusted;

(b) a torque limiter incorporated in the approach/separation mechanism, for cutting off a pressing force applied to the paper sheet by means of the print head and the platen when the pressing force exceeds a predetermined value; and (c) approach/separation control means for controlling the approach/separation mechanism such that either the print head or the platen is moved, from an initial position, closer to a pressing position where the paper sheet is to be pressed by the print head and the platen, and then moved to an origin position, being far away from the paper sheet, and then moved from the origin position, by an appropriate pressing distance obtained by subtracting an appropriate value for the printing gap from the distance between the pressing position and the origin position, in the direction in which the relative positions of the print head and the platen come closer.

According to the printing gap adjustment system of the invention, the approach/separation control means performs control to move the print head or the platen from an initial position to a pressing position where the paper is to be pressed by the print head and the platen. At the pressing position, the paper is pressed by the print head and the platen. The moving distance of the print head or the platen at that time is longer than the distance between the initial position and the pressing position and a pressing force caused by the excessive movement after the print head or the platen has reached the pressing position is cut off by the torque limiter. Thereafter, the approach/separation control means performs control such that the print head or the platen is moved from the pressing position to the origin position, and an appropriate pressing distance is calculated by subtracting an appropriate value for the printing gap from the distance between the pressing position and the origin position, and then the operation is reversed to move the print head or the platen from the origin position by the appropriate pressing distance so that the relative positions of the print head and the platen come closer.

Preferably, the origin position is detected by an origin sensor for detecting the state that the print head or the platen which has moved from the pressing position reaches the origin position.

The approach/separation control means preferably comprises:

(a) initial movement control means for initially moving the print head or the platen from the initial position to the pressing position where the paper sheet is to be pressed by the print head and the platen;

(b) reverse movement control means for moving the print head or the platen to the origin position, being far away from the paper sheet and obtaining its moving distance, after the initial movement by the initial movement control means has been completed;

(c) computing means for calculating the appropriate pressing distance by subtracting the appropriate value for the printing gap from the distance between the pressing position and the origin position, the distance being obtained by the reverse movement control means; and (d) adjustment movement control means for moving the print head or the platen from the origin position by the appropriate pressing distance so that the relative positions of the print head and the platen come closer.

Preferably the approach/separation control means performs control such that the print head or the platen is repeatedly reciprocated between the pressing position and the origin position a plurality of number of times and the distance between the pressing position and the origin position is detected a plurality of number of times. The computing means computes the average of a plurality of detection values of the distance between the pressing position and the origin position. The appropriate value for the printing gap is subtracted from the average value to obtain the appropriate pressing distance. Such a calculation process enables high-accuracy printing gap adjustment.

The printing gap adjustment system of the invention further comprises paper width detecting means for detecting the width of the paper sheet on which images are to be printed. The computing means preferably corrects the appropriate pressing distance based on the width of the paper sheet detected by the paper width detecting means. With this arrangement, paper width data can be taken into account when obtaining the appropriate pressing distance (i.e., when obtaining the appropriate value for the printing gap), particularly, in cases where printing images are printed on a narrow paper sheet, so that the influence of paper width can be eliminated when detecting the force for pressing the platen against the print head. In consequence, troubles, which are likely to occur when the printing gap is narrowly set for a narrow paper sheet, can be avoided.

When a narrow paper sheet is used, the computing means preferably corrects the appropriate pressing distance so as to be shorter than that for a normal wide paper sheet.

It is preferable that the paper width detecting means detect the width of the paper sheet by detecting the gap between the right and left parts of at least one tractor which delivers the paper sheet, hooking in the feed holes formed on the paper sheet. In this case, either part (right or left) of the tractor or its supporting member may be provided with an object to be detected, while the other part (right or left) of the tractor or its supporting member may be provided with a paper width detecting sensor. The paper width detecting sensor may detect the gap between the right and left parts of the tractor by detecting the object. Such tractors may be disposed upstream and downstream the print head along a paper delivery direction. The supporting members mentioned herein are couplers for coupling the upstream tractor to the downstream tractor. It is also preferable that a plurality of paper width detecting sensors be provided and the width of the paper be detected by the use of the plurality of paper width detecting sensors at multiple positions. This enables more accurate paper width detection.

Preferably, the system of the invention further comprises abnormality detecting means for releasing a printing stop instruction when the paper width detecting means detects a state that the width of the paper sheet is out of a specified range. The system of the invention may further comprise paper detecting means for detecting a state that the paper sheet is positioned between the print head and the platen prior to actuation of the approach/separation mechanism, The system of the invention may further comprise paper feed control means which slightly, reversely rotates the upstream tractor positioned upstream the print head along the paper delivery direction and/or slightly, forwardly rotates the downstream tractor positioned downstream the print head along the paper delivery direction, upon detection of the presence of the paper sheet by the paper detecting means. This allows paper gap adjustment with the paper sheet being tensioned.

The system of the invention may further comprise restarting means for restarting actuation of the printing gap adjustment system when a preset condition is satisfied during printing operation. The preset condition may be selected from (1) a detection of a state that printing time more than a certain value has elapsed; (2) a detection of a state that the number of continuous printing lines has reached a predetermined value; (3) a detection of printing completion for paper sheets stored in one paper hopper; (4) a detection of completion of one job and (5) a detection of a change in the temperature of the platen more than a predetermined value. Alternatively, a plurality of conditions selected from above may be used as the preset condition.

The computing means preferably includes the function to compute paper thickness based on the distance between the pressing position and the origin position and has printing density control means for controlling printing density in accordance with the paper thickness calculated by the computing means. The printing density control means may be overprinting control means which prints the same image data on the same position of the paper sheet a fixed number of times which is determined according to the paper thickness; drive current control means for controlling a drive current to be supplied to the print head according to the paper thickness; or printing speed control means which controls the printing speed of the print head and energizing time according to the paper thickness.

The system of the invention preferably comprises power supply maintaining means for maintaining power supply for a predetermined time when the power switch of the printing unit is turned off and releasing means for separating the relative positions of the platen and the print head when the power supply maintaining means has detected a turn-off of the power switch. With this arrangement, paper insert operation can be performed with ease when the power switch is turned off.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIG. 1 is a side view of an impact printer;

FIG. 2 is a diagram showing the system structure of the paper gap adjustment system;

FIG. 3 is a flow chart of a printing gap adjustment process;

FIG. 4 is a block diagram showing the functions of the printing gap adjustment system;

FIG. 5 is an explanatory diagram of printing gap adjustment operation by a platen;

FIG. 6 is a time chart schematically showing the operation of the platen;

FIG. 7 is a flow chart of control operation by printing density control means, restarting means and power supply maintaining means;

FIG. 8 is a flow chart of control operation by overprinting control means;

FIGS. 9(*a*) and 9(*b*) are explanatory diagrams showing a platen pressed against paper sheets having different widths;

FIG. 10(*a*) is a graph showing the relationship between the pressing force of the platen and paper width;

FIG. 10(*b*) is a graph showing the relationship between calculated paper thickness and paper width;

FIG. 11 is a plan view of a paper width detecting mechanism;

FIG. 12 is a plan view of a paper width detecting mechanism according to a modified example;

FIG. 13 is a block diagram showing the function of essential parts when using a paper sheet which does not meet a specification;

DETAILED DESCRIPTION OF THE PREFERRED EMBODIMENTS

Referring now to the accompanying drawings, preferred embodiments of a printing gap adjustment method and printing gap adjustment system according to the invention will be described.

Figure 1:
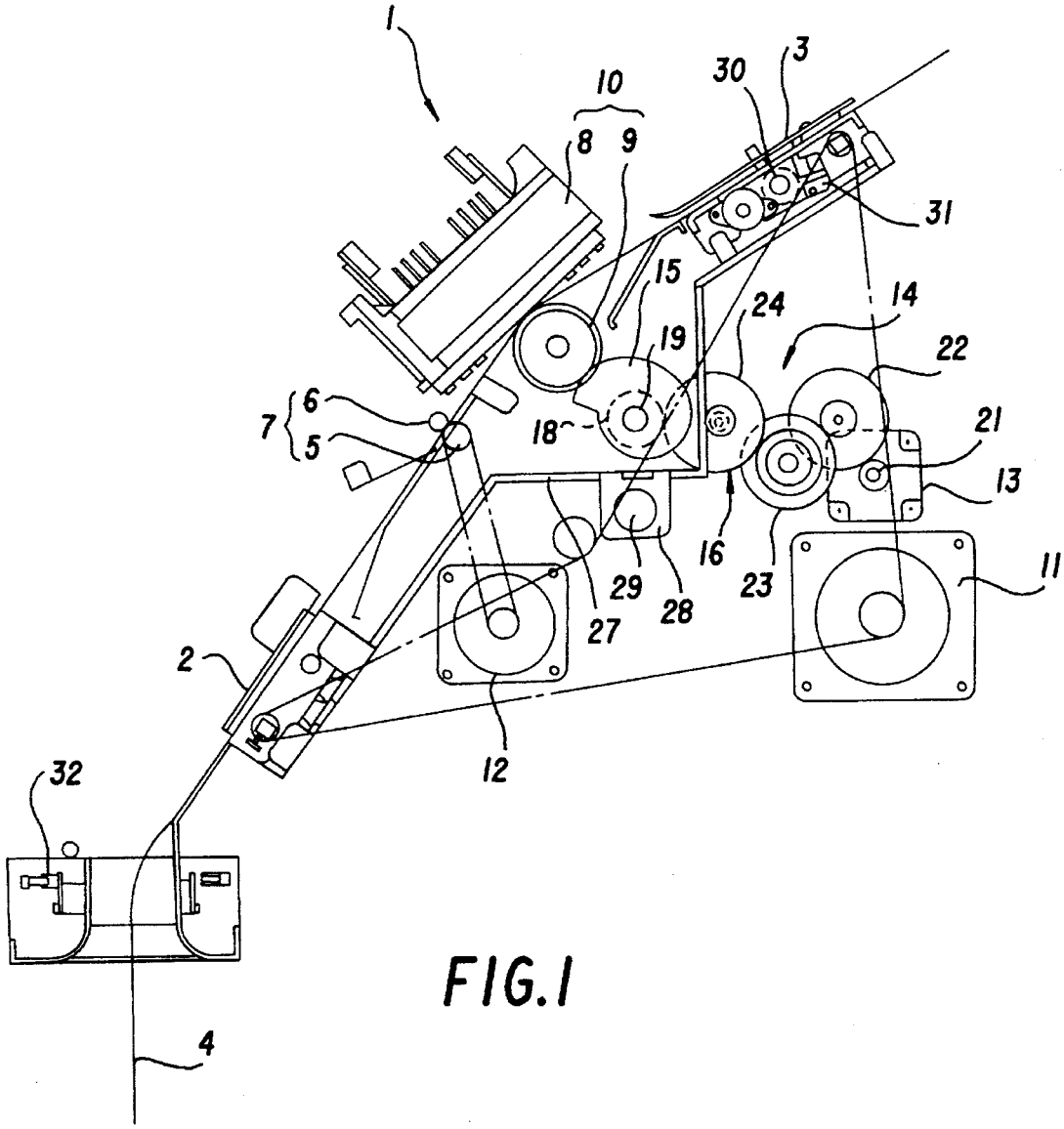
FIGS. 1 to 8 are associated with a printing gap adjustment method and a printing gap adjustment system according to one preferred embodiment of the invention.

FIG. 1 shows an impact printer 1 according to one embodiment of the invention, in which an upstream tractor (lower tractor) 2 is positioned at a lower front part (on the left of FIG. 1) of a machine body frame (not shown) and a downstream tractor (upper tractor) 3 is positioned at an upper rear part (on the right of FIG. 1) of the machine body frame. The upstream tractor 2 and downstream tractor 3 are respectively composed of a right part and left part. Disposed under the upstream tractor 2 is a paper hopper (not shown) for storing continuous forms paper (hereinafter referred to as "paper") 4 stacked thereon. Delivery rollers (resist rollers) 7 composed of a drive roller 5 and a pinch roller 6 are positioned between the upstream tractor 2 and the downstream tractor 3. On the downstream side of the delivery rollers 7, there is provided a printing unit 10 comprising a print head 8 and a platen 9.

Figure 2:
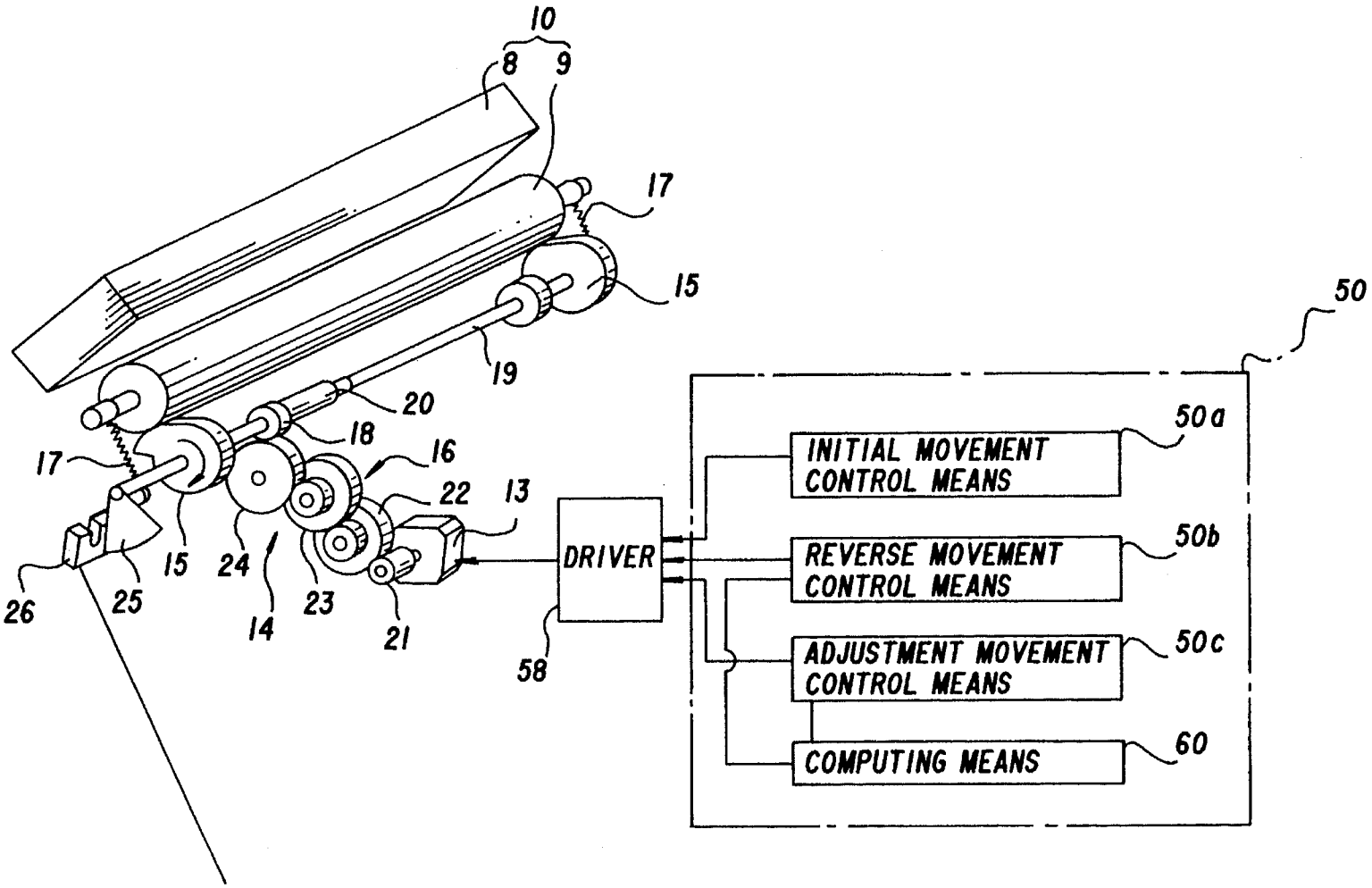

The upstream tractor 2 and downstream tractor 3 are synchronously driven by a first delivery motor 11 while the drive roller 5 is driven by a second delivery motor 12. As shown in FIG. 2, an approach/separation mechanism 14 driven by a motor (stepping motor) 13 operates the platen 9 so as to move closer to or away from the print head 8, which adjusts the relative positions (i.e., printing gap) of the platen 9 and the print head 8.

The approach/separation mechanism 14 comprises a pair of cams 15 disposed in contact with both ends of the platen 9; a gear train 16 for transmitting the driving force of the motor 13 to the cams 15; and a pair of coil springs 17 for energizing the platen 9 so as to be pressed against the cams 15. Disposed between a final gear 18 of the gear train 16 and a rotary shaft 19 for supporting the cams 15 is a torque limiter 20 which cuts off the transmission of the driving force from the final gear 18 to the cams 15 when torque more than a predetermined value is applied to the cams 15. Between an initial gear 21 and the final gear 18 of the gear train 16, there are provided double reduction gears 22, 23 and an intermediate gear 24.

A shielding plate 25 is secured to one end of the rotary shaft 19 for supporting the cams 15. An origin sensor 26 for detecting the state that the platen 9 has moved to an origin position N (see FIG. 5) which is a predetermined distance away from the print head 8 is attached to the machine body frame at a position close to the shielding plate 25. The origin sensor 26 is composed of a photointerrupter whose optical path is closed by the shielding plate 25 during the movement of the platen 9 from the pressing position to the origin position and opened when the platen 9 has reached the origin position.

The right or left parts (when viewed in the paper delivery direction) of the upstream tractor 2 and the downstream tractor 3 are integrally coupled to each other with the help of a coupler 27 which is bent at approximately right angles at its center and outwardly bent at an obtuse angle at both ends. A supporting bracket 28 is attached in proximate to the squarely bent portion of the coupler 27 and a support shaft 29 is fixed to the machine body frame, penetrating through the supporting bracket 28. The coupler 27 is supported to the support shaft 29 through a thrust ball bearing such that the coupler 27 is slidable laterally with respect to the paper delivery direction. By means of a locking means (not shown), the downstream tractor 3 is lockable to a lock shaft 30 which is so secured to the machine body frame as to penetrate through the downstream tractor 3. The downstream tractor 3 is released from its locked condition and the upstream tractor 2 is grasped to slide the supporting bracket 28 along the support shaft 29, whereby the positions of, for example, the right parts (when viewed in the paper delivery direction) of the tractors 2 and 3 can be adjusted laterally in accordance with the size (i.e., width) of the paper 4. After such positional adjustment, the tractor holes of the paper 4 are hooked on the tractor pins of the upstream tractor 2 and then the downstream tractor 3 is fixed to the lock shaft 30.

The downstream tractor 3 is provided with a paper lead end detecting sensor 31 for detecting the lead end of the paper 4 when pressed by the lead end of the paper 4 being delivered. On the upstream side of the upstream tractor 2, there is provided a paper trail end detecting sensor 32 for detecting the presence of the paper 4 within the paper hopper.

In the printer having the above construction, the paper 4 fed from the paper hopper passes the paper trail end detecting sensor 32 and enters the upstream tractor 2. Then, the paper 4 is delivered into the printing unit 10 by the delivery rollers 7 in synchronization with the operation of the print head 8. After printing on the line basis has been performed by the printing unit 10, the paper 4 is let out of the printing unit 10 by line spacing by the downstream tractor 3 and finally delivered to the discharged paper tray or stacker.

Figure 3:
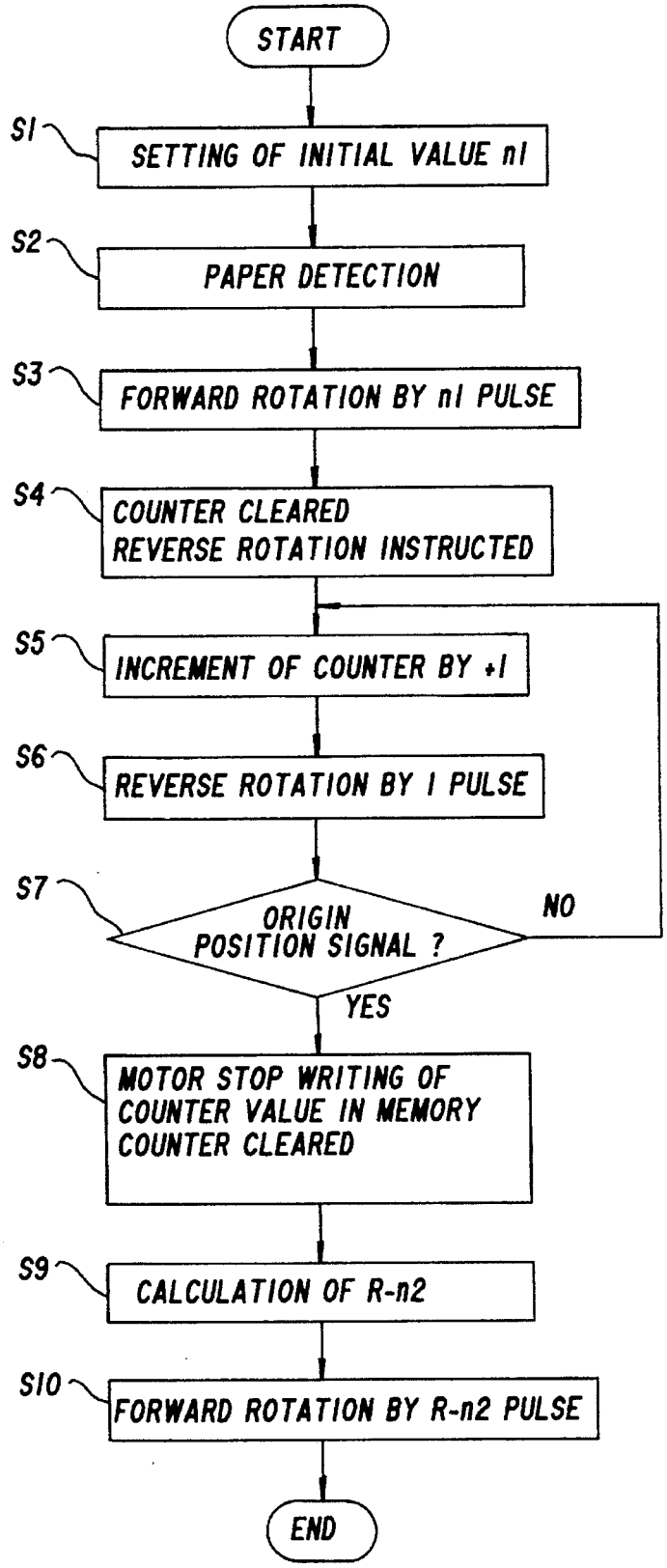
Figure 4:
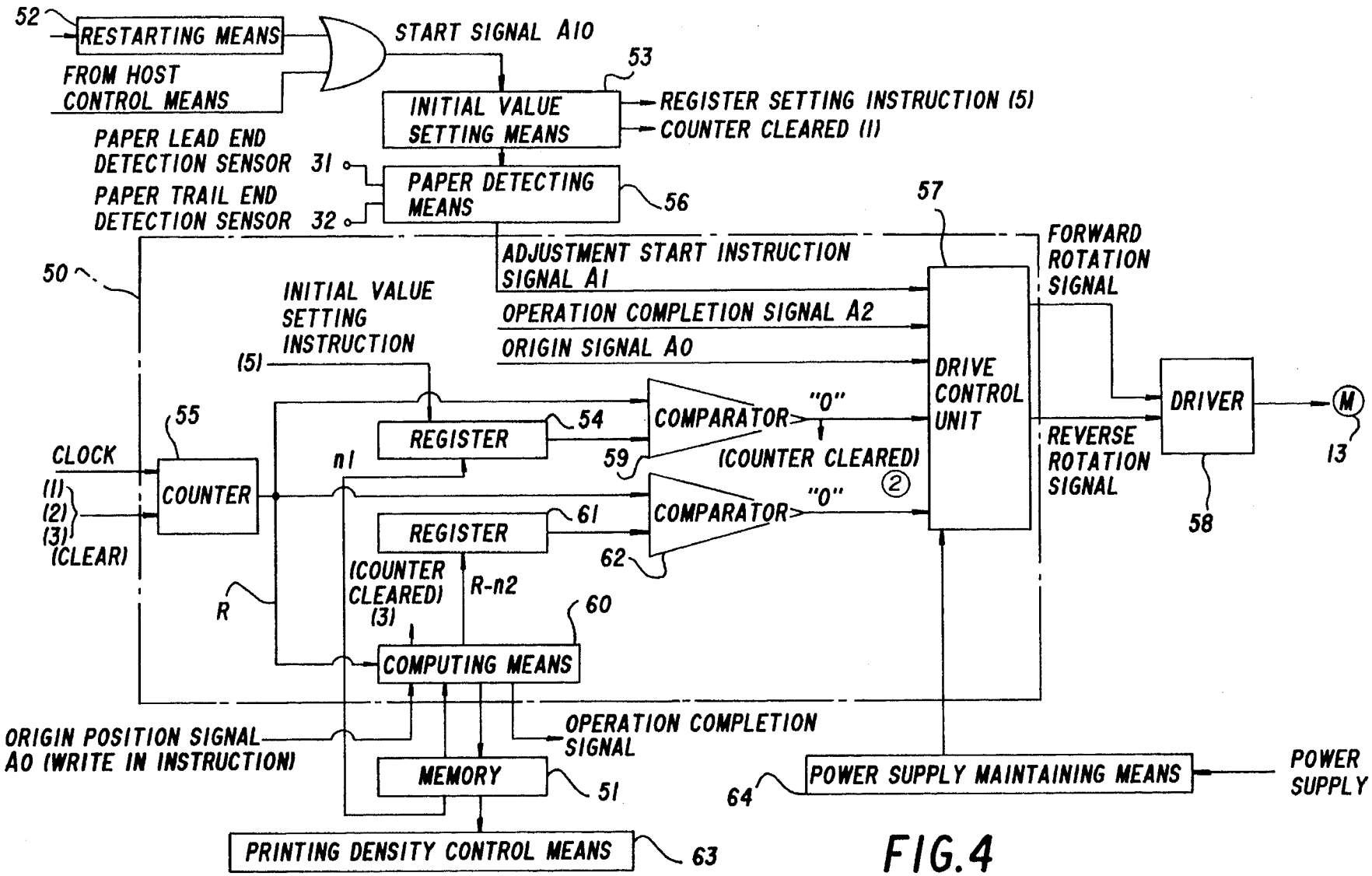
Figure 5:
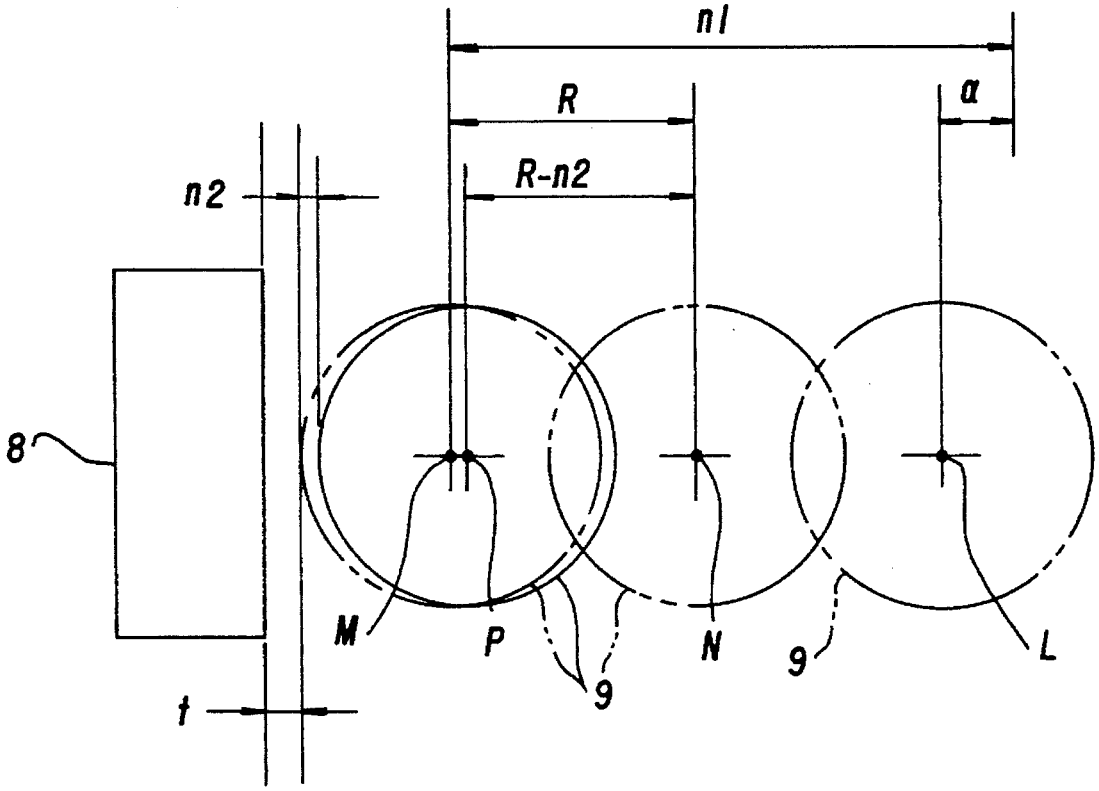

In the impact printer 1 according to this embodiment, the rotating direction and rotating amount of the motor 13 are controlled by an approach/separation control means 50 (see FIG. 4). The process of adjustment of the printing gap between the print head 8 and the platen 9 by controlling the motor 13 will be described referring to the flow chart of FIG. 3 in conjunction with FIGS. 4 and 5. FIG. 4 is a block diagram showing the functions of the printing gap adjustment system according to this embodiment and FIG. 5 is an explanatory diagram of the printing gap adjustment operation by the platen 9. Note that distance is equivalent to the number of pulses in the following description.

S1: Upon turning on of the power supply of the printer, data such as an initial value n1 and an appropriate gap value n2 according to paper thickness are written in a memory 51 from a ROM (read only memory: not shown)in which preset values are stored. After such data have been written in the memory 51, a start signal $A_{10}$ generated by a host control means or restarting means 52 (described later) is input in an initial value setting means 53. Then, the initial value setting means 53 reads the initial value n1 from the memory 51 and sets it in a register 54 while clearing a counter 55. The initial value n1 represents the distance of the initial movement of the platen 9 in the number of pulses and is set to a value which is $\alpha$ pulses more than the maximum distance (=number of pulses) between the print head 8 and the platen 9 positioned at its initial position L (see FIG. 5). Although the initial position L of the platen 9 is not fixed, the maximum distance between the print head 8 and the platen 9 is a given value.

S2: Based on the output of the paper lead end detecting sensor 31 and the output of the paper trail end detecting sensor 32, a paper detecting means 56 detects the presence of the paper 4 between the print head 8 and the platen 9. Upon detection, an adjustment start instruction signal $A_1$ is input in a drive control unit 57.

S3 to S4: After receiving the adjustment start instruction signal $A_1$, the drive control unit 57 releases, for example, a forward rotation signal "1" to a driver 58 to forwardly rotate the motor 13 and to start up the counter 55. In a comparator unit 59, the count value of the counter 55 is compared to the initial value n1 set in the register 54. When the state that the count value becomes equal to the initial value n1 is detected in the comparator unit 59, the drive control unit 57 releases, for example, a forward rotation signal "0" to the driver 58, thereby instructing a stop of the motor 13 while clearing the counter 55. Then, the drive control unit 57 releases, for example, a reverse rotation signal "1" to the driver 58, thereby instructing reverse rotation. Since the initial value n1 is set to a value which is $\alpha$ pulses longer than the maximum distance between the print head 8 and the initial position L of the platen 9, the motor 13 excessively rotates at least by $\alpha$ pulses after the platen 9 has reached the pressing position M during its initial movement. However, the torque limiter 20 incorporated in the approach/separation mechanism 14 allows this rotation by the excessive number of pulses to flee, so that the platen 9 is securely pressed by a prescribed pressing force against the print head 8 with the paper 4 held therebetween. The counter 55, register 54, comparator unit 59 and drive control unit 57 constitute an initial movement control means **50*a* (see FIG. 2) of the approach/separation control means 50**.

S5 to S8: When the motor 13 has been reversely rotated in response to the reverse rotation signal from the drive control unit 57, the counter 55 is sequentially incremented, following the reverse rotation. The increment of the counter 55 is continued until a release of an origin position signal $A_0$ from the origin sensor 26 is detected. After the platen 9 has been moved to the origin position N and the origin position signal $A_0$ has been released from the origin sensor 26, the origin position signal $A_0$ is input in the drive control unit 57 and the drive control unit 57, in turn, sends a reverse rotation signal "0" to the driver 58, for instructing a stop of the motor 13 while sending a stop instruction to the counter 55.

The origin position signal $A_0$ is also input in a computing means 60, which allows the computing means 60 to read the count value R of the counter 55 (i.e., the distance between the pressing position M and the origin position N). Thereafter, the counter 55 is cleared. The drive control unit 57 and the counter 55 constitute a reverse movement control means 50*b* of the approach/separation control means 50 (see FIG. 2).

S9: The computing means 60 obtains an appropriate pressing distance R–n2 by subtracting the appropriate gap value n2 read from the memory 51 from the counter value R read from the counter 55. The appropriate pressing distance R–n2 is set in a register 61 while an operation completion signal $A_2$ is input in the drive control unit 57.

S10: After the operation completion signal $A_2$ has been input, the drive control unit 57 sends a forward rotation instruction to the driver 58 to forwardly rotate the motor 13 while starting counting by the counter 55. In a comparator unit 62, the count value of the counter 55 is compared to the preset value R–n2 in the register 61. After the motor 13 has forwardly rotated by R–n2 pulses, the drive control unit 57 outputs a stop instruction to the driver 58. Upon receipt of the stop instruction, the driver 58 stops the motor 13 to terminate the operation of the approach/separation control means 50 so that the platen 9 is positioned at an appropriate position P. The counter 55, register 61, comparator unit 62 and drive control unit 57 constitute an adjustment movement control means 50*c* (see FIG. 2) of the approach/separation control means 50.

Figures 6A, 6B, 6C, 6D:
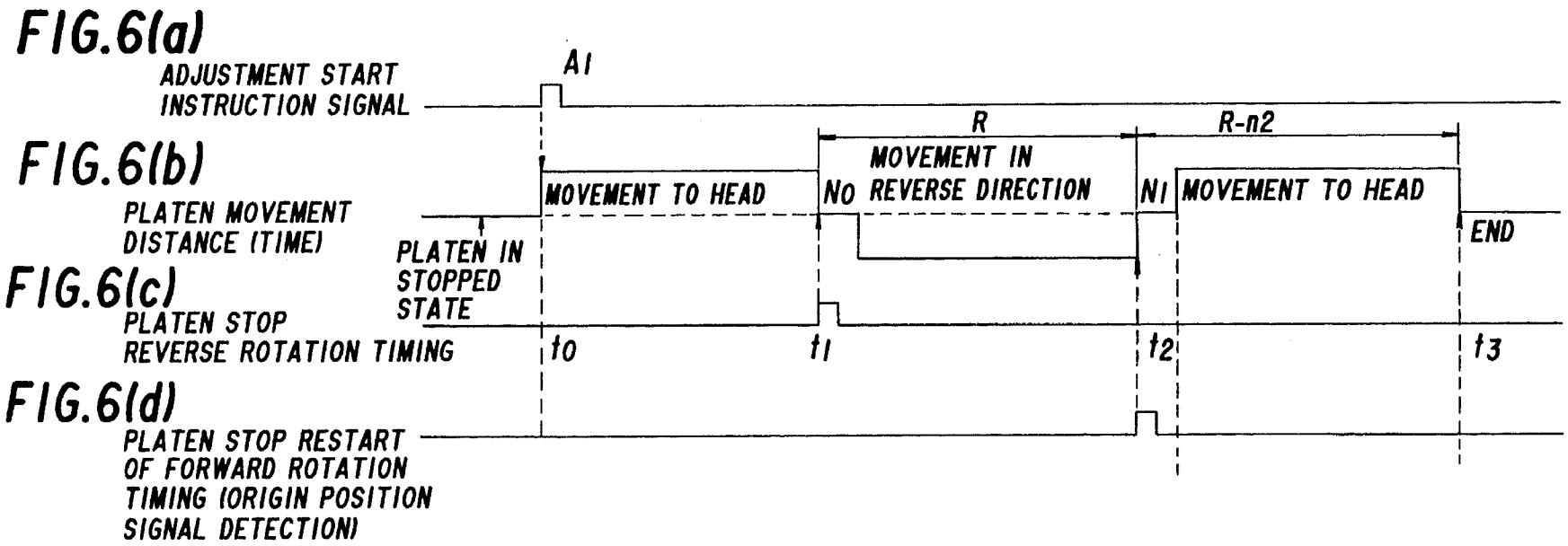

Reference is now made to the time chart of FIG. 6 to describe the outline of the operation of the platen 9.

At the time point $t_0$ when an adjustment start instruction signal $A_1$ is generated, the platen 9 starts to move toward the print head 8. At the stop/reverse rotation time point $t_1$, the rotation of the platen 9 is changed from the forward direction to the reverse direction. At the stop/forward rotation restarting time point $t_2$ when the origin position signal is detected, the rotation of the platen 9 is again changed from the reverse direction to the forward direction. At the time point 13, a series of operation of the platen 9 is terminated.

The count value R obtained by the counter 55 during the time ($t_2$–$t_1$) when the platen 9 is moved from the pressing position M to the origin position N includes backlash $N_0$ which occurs in the approach/separation mechanism 14 when the rotating direction of the motor 13 is changed at the pressing position M and includes the number of pulses corresponding to the distance between the pressing position M and the origin position N. When the motor 13 is forwardly rotated at the time point $t_2$ by the number of pulses obtained by subtracting the appropriate gap value n2 from the count value R, the platen 9 starts to move from the origin position N after backlash $N_1$ (=$N_0$) has been eliminated. This backlash occurred in the approach/separation mechanism 14 due to changing of the rotational direction of the motor 13 at the origin position N. In this way, the backlash $N_0$ at the pressing position M and the backlash $N_1$ at the origin position N, which differ from each other in direction but are the same in degree, are offset by each other, so that the platen 9 can be accurately moved to the appropriate position, that is, the position where the appropriate gap n2 is present between the print head 8 and the platen 9 with the paper 4 held within this gap.

At the appropriate position, the platen 9 is pressed against the cams 15 by means of the coil springs 17 and therefore there is no chance that the platen 9 moves from the appropriate position toward the print head 8. Unless the motor 13 is reversely rotated, the platen 9 will not move from the appropriate position in the direction away from the print head 8.

Referring to FIG. 6, the excessive pulse time (i.e., the time during which the torque limiter 20 is in operation) during the initial movement is included in the time between the time point $t_0$ when the adjustment start instruction signal $A_1$ is generated and the time point $t_1$ when reverse rotation starts. The time required for the arithmetic operation by the computing means 60 at the time point $t_2$ when the rotation is again changed from the reverse direction to the forward direction is very small and therefore ignored.

In this way, the platen 9 is accurately positioned at the appropriate position and in consequence, proper printing gap adjustment can be performed to prevent troubles such as a bend or snap of the dot pin and jam. In addition, appropriate printing gap adjustment can be automatically performed so that troublesome manual gap adjustment work and test printing for checking the result of the adjustment work are no longer necessary.

The computing means 60 has the function to calculate paper thickness t in such a way that the origin value (i.e., the value corresponding to the distance between the origin position N and the position of the platen 9 which is pressed against the print head 8 without the paper 4 held therebetween) is read from the memory 51 and the count value R of the counter 55 is subtracted from this origin value. The paper thickness t is calculated when the aforesaid appropriate pressing distance R–n2 is calculated (in step S9 in FIG. 3) and once stored in the memory 51. After completion of the above-described gap adjustment process, the paper thickness t is output to a printing density control means 63 on request and used for printing density control.

There are some cases where it is not sufficient to perform the printing gap adjustment only once when starting up the printer. For example, if the printer is continuously operated, the temperature of the print head 8 rises causing thermal expansion and this makes the printing gap narrower than the appropriate value. In such a case, readjustment for the printing gap becomes necessary. For this reason, the system of this embodiment is provided with the restarting means 52 which outputs a start signal $A_{10}$ to restart the gap adjustment mechanism even during printing operation if a predetermined condition is satisfied.

Further, the system of this embodiment is provided with a power supply maintaining means 64 which maintains a supply of power for a predetermined time while outputting a reverse rotation instruction to the drive control unit 57, when the power switch for the printer is turned off. This releases the gap adjustment mechanism to facilitate the paper inserting work when the power supply is turned off.

Figure 7:
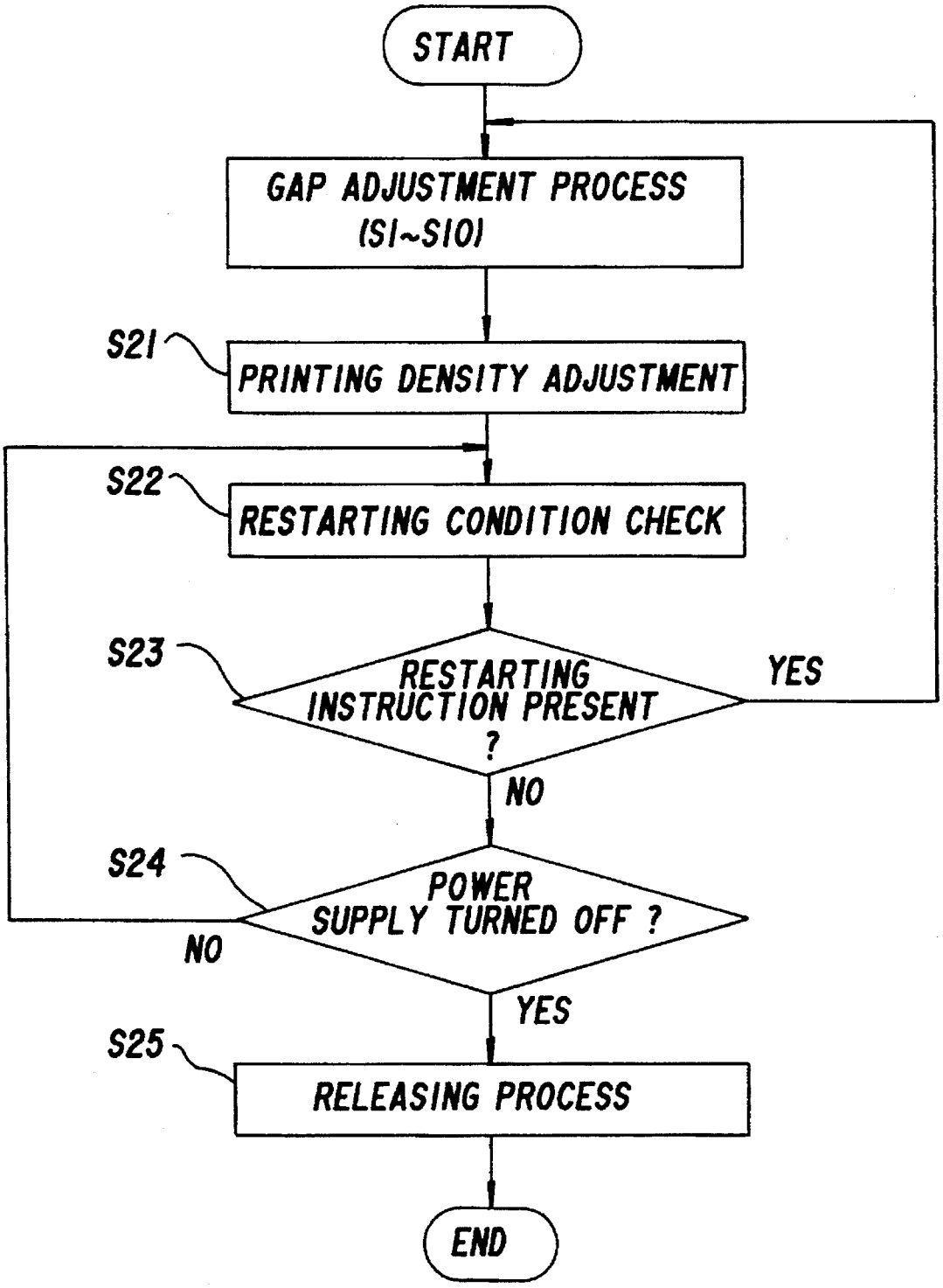

Referring to the flow chart of FIG. 7, the control operation by the printing density control means 63, restarting means 52 and power supply maintaining means 64 will be explained.

S21: After the gap adjustment process (Steps S1 to S10) shown in FIG. 3 has been completed, the printing density control means 63 performs printing density control according to the paper thickness t stored in the memory 51. As the printing density control means 63, (1) an overprinting control means; (2) a drive current control means; or (3) a printing speed control means may be employed. When using the overprinting control means, the number of times the dot pin should strike the same position on the paper 4 is preliminarily set according to the paper thickness t. In this case, the larger paper thickness is, the more the dot pin strikes the same position. The drive current control means controls, according to the paper thickness t, a drive current which determines the strength of the striking force of the dot pin of the print head 8. The printing speed control means controls the printing speed and energizing time of the print head 8 according to the paper thickness t. For adjusting printing density to be an appropriate value, the overprinting control means increases the number of overprinting operations as the paper thickness increases; the drive current control means increases the value of the current as the paper thickness increases; and the printing speed control means prolongs the time when an exciting current flows and decreases printing speed as the paper thickness increases. The control operation in the case of the overprinting control means will be described later with reference to the flow chart of FIG. 8.

S22 to S23: A check is made to determine if a restarting condition is satisfied. If a restarting instruction is generated, the gap adjustment process (Steps S1 to S10 in FIG. 3) is executed again. The restarting condition may be selected from (1) printing time more than a predetermined time has elapsed, (2) the number of continuous printing lines has reached a predetermined value, (3) printing on the paper stored in one paper hopper has been completed, (4) one job has been completed and (5) the temperature of the platen 9 has changed more than a predetermined value. Alternatively, a plurality of conditions selected from above may be used in combination.

In the case of the restarting means 52 for restarting the printing gap adjustment system according to whether the number of continuous printing lines has reached a predetermined value, line positions are preliminarily set in correspondence with the values of paper thickness and the restarting means 52 may be operated at a predetermined line position. With this arrangement, when a medium whose thickness varies depending on parts is used, the gap between the print head 8 and the platen 9 can be widened for thicker parts and narrowed for thinner parts, so that the printing gap can be appropriately adjusted according to the variations in the thickness of the paper. As a result, troubles such as jam and snapping or bending of the dot pin can be securely prevented even when a medium irregular in thickness, which is liable to such troubles, is used.

In a case where the gap adjustment system is restarted according to the temperature of the platen 9, a temperature sensor is embedded in the platen 9 and restarting is executed provided that the temperature detected by the temperature sensor is a predetermined value higher or lower than the temperature detected when the gap adjustment system was previously started up.

S24 to S25: When the power supply for the printer is turned off, the gap adjustment system is released by a releasing means (not shown). Specifically, the motor 13 is reversely driven to widen the gap between the platen 9 and the print head 8. The distance of the reverse rotation at that time corresponds to the number of pulses R−n2 which has been set in the register 61, for example, during the adjustment movement control (Step S10 in FIG. 3) described earlier and this reverse rotation allows the platen 9 to be put back to the origin position N. When the power supply is not turned off on the other hand, the program returns to Step S22. Note that the releasing means is also made up of the counter 55, register 61 and comparator unit 62 of the approach/separation control means 50 and the drive control unit 57.

Figure 8:
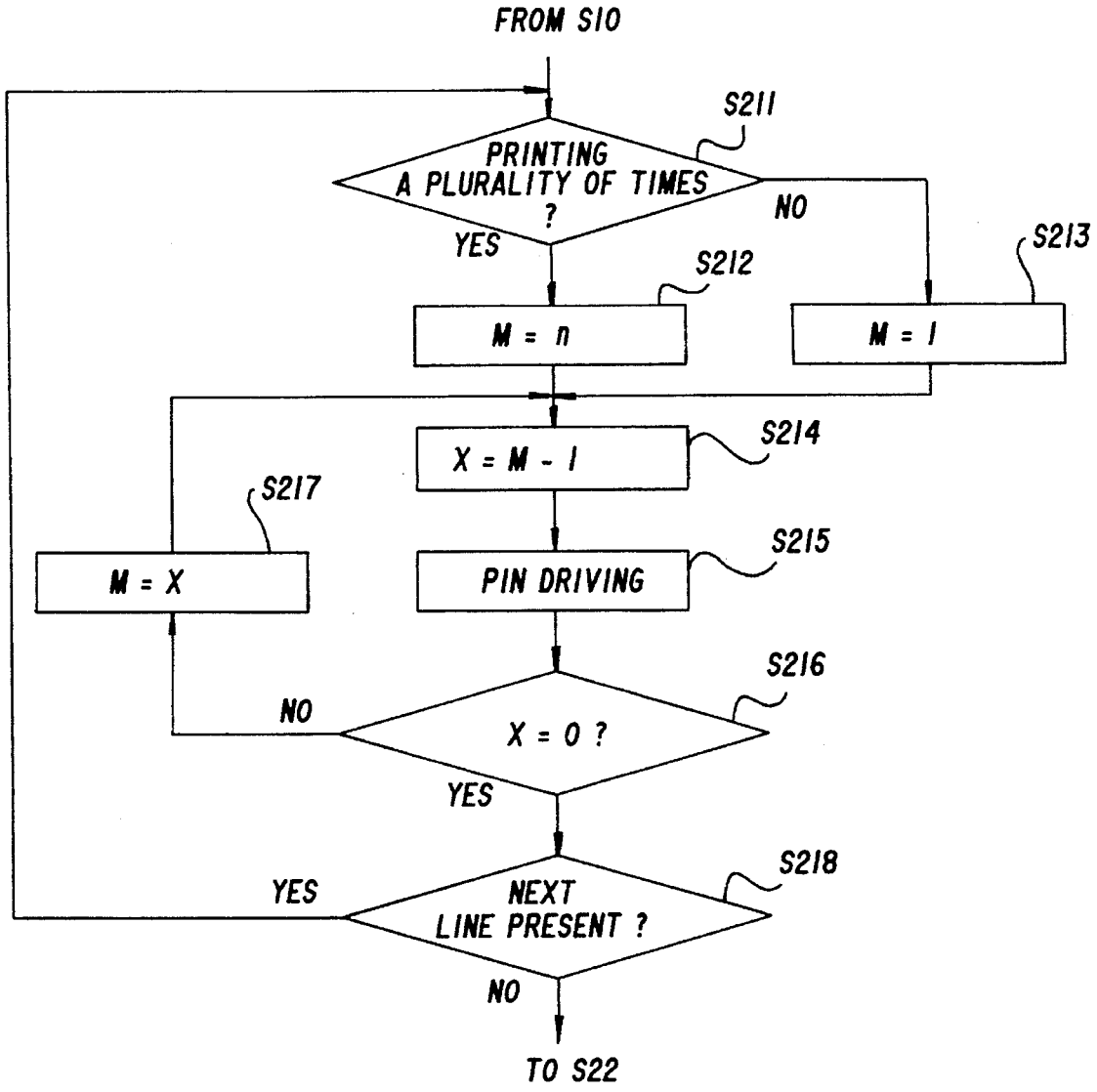

The control operation by the overprinting control means will be explained with reference to the flow chart of FIG. 8.

S211 to S213: If a plurality of printing operations need to be performed, the number of printing operations M is set to a predetermined number n (M=n), and if not, the number of printing operations M is set to 1 (M= 1).

S214 to S217: The number of printing operations M is sequentially decremented (X= M−1), while the dot pin of the print head 8 performs its operation. This process is continued until the value X reaches zero.

S218: When X= 0, a check is made to determine if the next line exists. If so, the program returns to S211 to repeat the same process. If not, the program proceeds to the step for restarting (S22 in FIG. 7).

Another embodiment of the invention will be described. In this embodiment, when calculating the paper thickness t by the computing means 60 as described earlier, the aforesaid appropriate pressing distance R−n2 is corrected according to paper width, in consideration of the fact that as paper width becomes small, the force for pressing the platen 9 against the print head 8 increases.

Figure 9A:
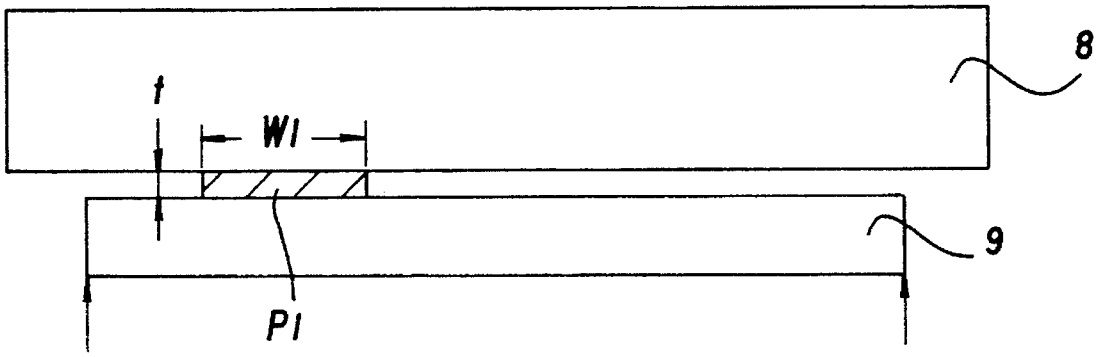
FIGS. 9 to 13 are associated with a printing gap adjustment method and a printing gap adjustment system according to another embodiment of the invention.
Figure 9B:
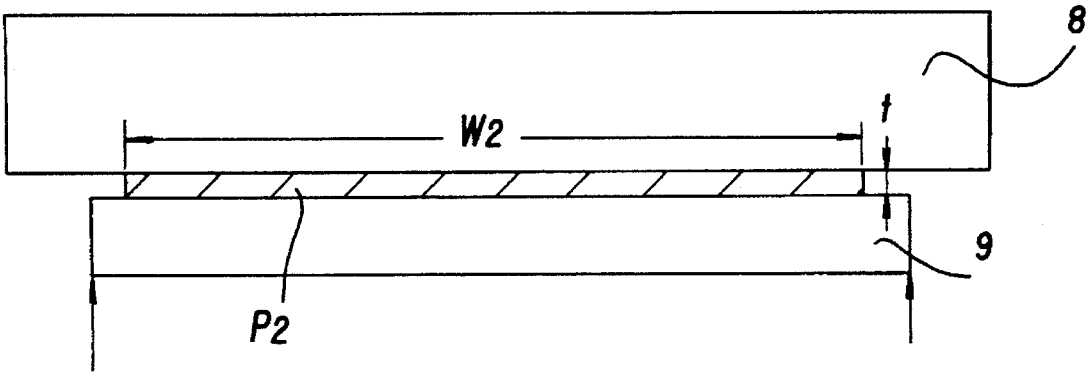
Figure 10A:
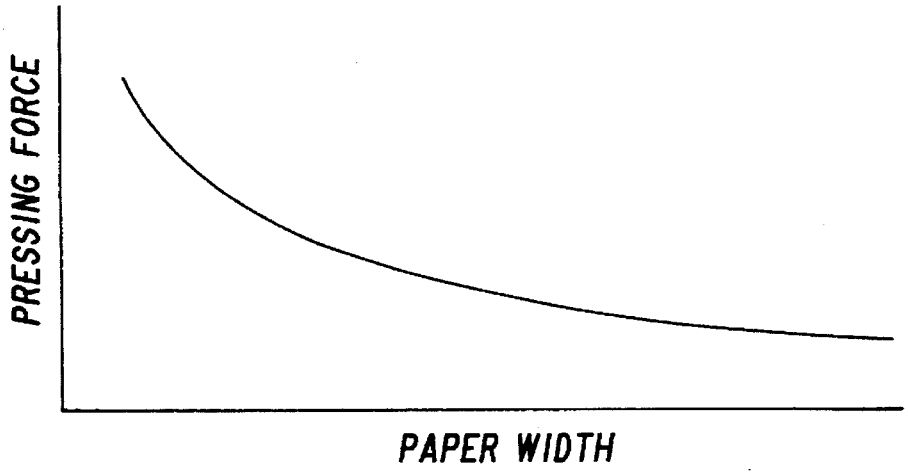
Figure 10B:
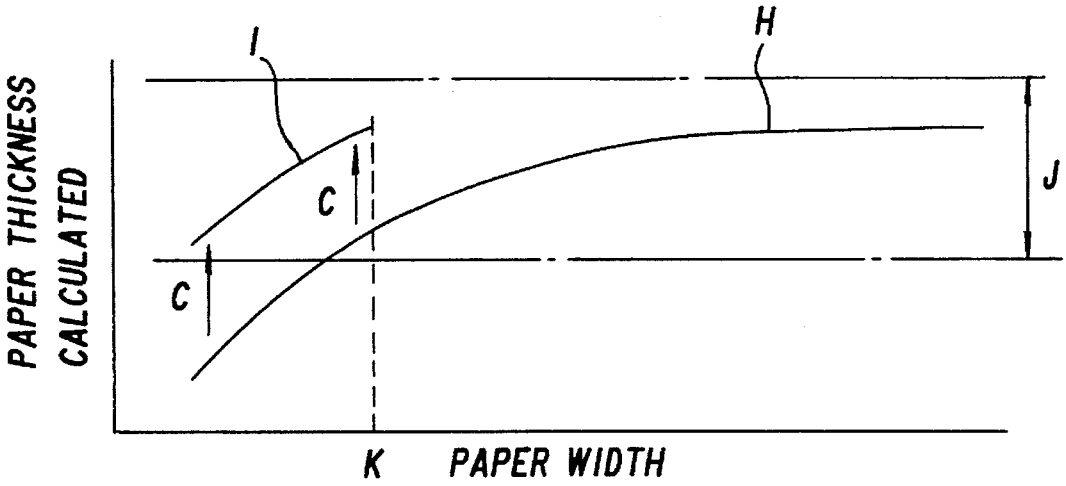

By the use of paper sheets which have the same thickness t and different widths $w_1$, $w_2$ as shown in FIGS. 9(*a*) and 9(*b*), the platen 9 is pressed against the print head 8. The force which presses the platen 9 against the print head 8 in the case of the narrower paper $p_1$ is greater than that in the case of the wider paper $p_2$, as shown in FIG. 10(*a*). If a paper sheet having a very small width is used, paper thickness obtained through calculation is less than the actual paper thickness as indicated by curve line H of FIG. 10(*b*). When the paper width is not more than a predetermined value, curve line H departs from an appropriate printing gap range J. Therefore, the system of this embodiment is provided with paper width detecting sensors (micro switches 71, 71' to be described later) for detecting the width of the paper 4, and if paper width data sent from these paper width detecting sensors is not more than the predetermined value K, the paper thickness is corrected such that curve line H in the region in which the paper width does not exceed the predetermined value K is shifted into curve line I, as indicated by arrow C. This allows the paper width-paper thickness curve line to fall within the appropriate printing gap range J.

More concretely, after the paper width detecting sensor has detected the state that the width of the paper set in the printer is not more than a predetermined value, the computing means 60 corrects the appropriate gap value n2 so as to be a little greater than that in the case of a normal wide paper. Namely, the computing means 60 corrects the appropriate pressing distance R−n2 to be shorter and the appropriate pressing distance R−n2 thus calculated is set in the register 61.

In this way, the paper thickness data is corrected according to the paper width data, so that the printing gap can be adjusted to be an appropriate value without having an influence of paper width even when a paper of a small width is used. This enables it to securely prevent troubles such as deterioration of print quality caused by distorted printed images; paper jam caused by a torn paper; and print head damage.

Figure 11:
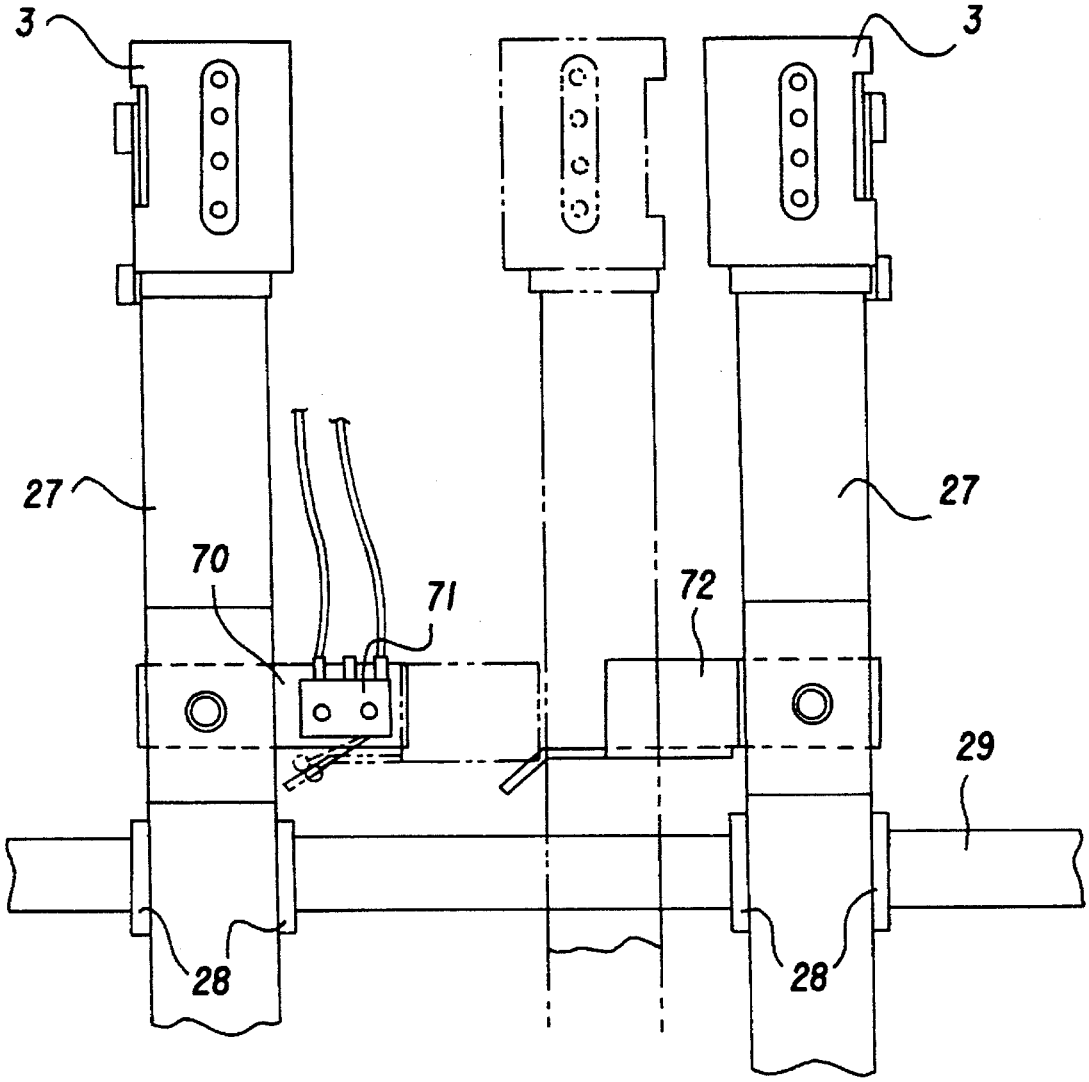

FIG. 11 shows one example of the paper width detection mechanism. The paper width detection mechanism shown in FIG. 11 comprises (1) a micro switch (paper width detecting sensor) 71 which is disposed on a bracket 70 attached to the coupler 27 positioned on the left hand when viewed in the paper delivery direction; and (2) an object 72 attached to the coupler 27 on the right hand, for putting the micro switch 71 in operation by pressing. In the mechanism having the above construction, if the right coupler 27 (more specifically, the right parts of the upstream tractor 2 and the downstream tractor 3) is adjusted according to paper width such that it is moved from the position indicated by solid line to the position indicated by chain line in FIG. 11, the object 72 will press the micro switch 71, whereby a narrow paper is detected as the paper 4 to be used.

Figure 12:
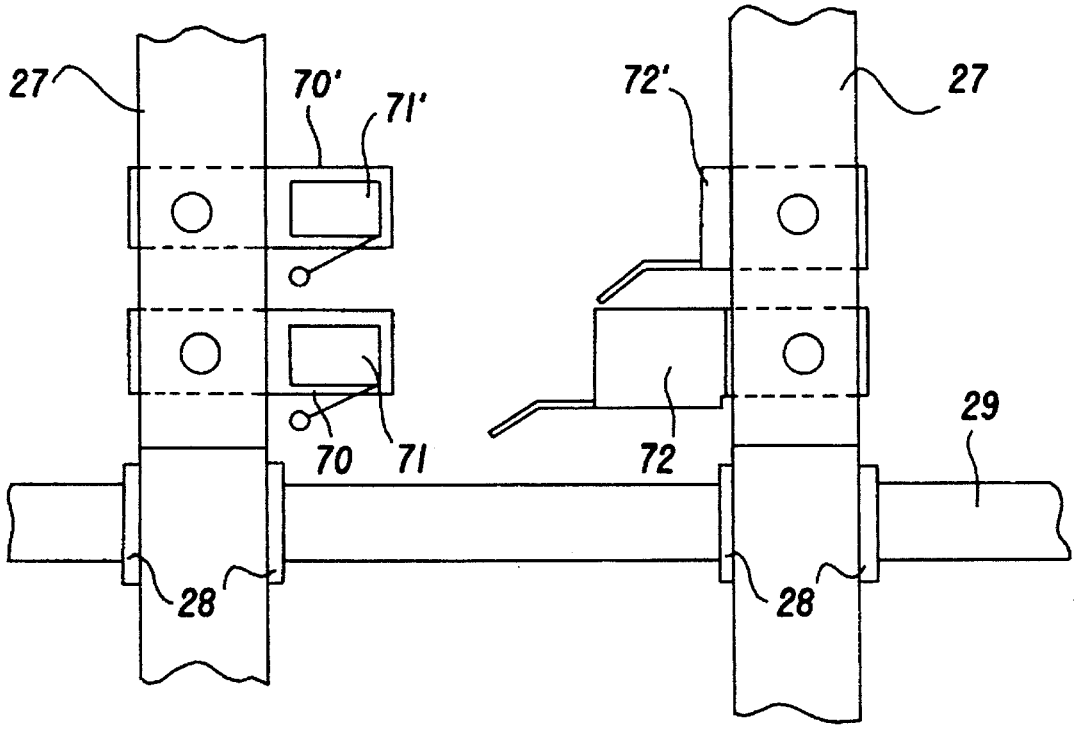

FIG. 12 shows a modified example of the paper width detection mechanism. This example includes another combination of a micro switch 71' and an object 72' in addition to the combination of the micro switch 71 and the object 72 described earlier. The object 72' is installed at a position shifted from the installing position of the object 72. With this arrangement, the operating position of the micro switch 71 can differ from that of the micro switch 71' so that paper width can be detected at three different positions. The use of a plurality of micro switches and objects in combination enables the detection of paper width at multiple positions so that the printing gap adjustment can be performed with higher accuracy.

The micro switches and objects may be directly attached to the upstream tractor and the downstream tractor themselves instead of being attached to the couplers for coupling these tractors. Sensors of other types such as electrooptical sensors may be employed in place of the micro switches. Although the gap between the right and left parts of each tractor is detected for obtaining paper width in the foregoing embodiment, the width of the paper itself may be detected.

Figure 13:
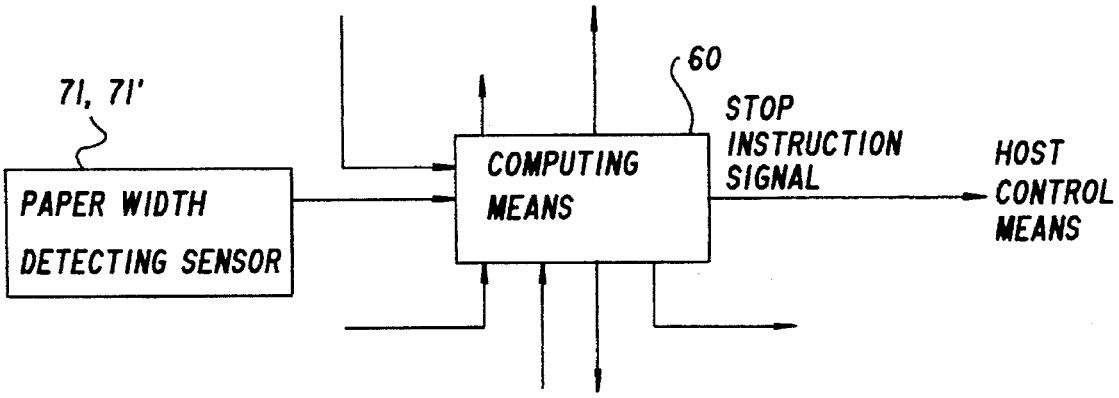

It is preferable in the foregoing embodiments that when a small width or great width which does not fall in a specified width range is detected by the paper width detecting sensor, the computing means 60 generates a stop instruction to the host control means for controlling the printing mechanism, delivery mechanism and other mechanisms incorporated in the printer, as shown in FIG. 13. This enables it to prevent troubles in printing operation as well as troubles in delivery operation caused by the use of a paper which does not meet the specification.

The foregoing embodiments have been particularly described with the case where paper thickness is corrected according to paper width, but the correction may be made in other ways. For example, giving attention to the fact that the thinner the paper 4 is, the smaller the detected value of paper thickness becomes owing to the stiffness or elasticity of the paper 4, detection errors are experientially obtained. Based on the paper thickness calculated taking a detection error into account, the appropriate gap value n2 may be corrected.

In the foregoing embodiments, the detection of the distance between the pressing position M and the origin position N is performed only once and the appropriate pressing distance R−n2 is calculated based on this detected distance. However, there sometimes occurs an error in the calculation of the appropriate pressing distance R−n2 owing to the error in the detection of the distance between the pressing position M and the origin position N. In order to ensure improved accuracy by reducing such an error, the approach/separation control means 50 may be provided with the following function: After the platen 9 has moved from the pressing position M to the origin position N, the platen 9 is controlled to reciprocate between the origin position N and the pressing position M a plurality of number of times. In the meantime, the distance between the pressing position M and the origin position N is detected repeatedly. The average of a plurality of distance data pieces thus obtained is calculated.

In the foregoing embodiments, if the platen 9 is pressed against the paper 4 on the position where perforations are formed in the paper 4, the printing gap adjustment is undesirably performed at a position where the thickness is different from the actual paper thickness. In order to avoid such a situation, the following arrangement is preferable. After the lead end of the paper 4 has been detected by the paper trail end detecting sensor 32, based on the given value of the distance between the lead end of the paper 4 and the perforations, the paper delivery control means (not shown) delivers the paper 4 until the pressing position comes to a position where the perforations do not exist. Note that this method is effective only when initial paper setting is carried out.

A slack in the paper 4 could be a cause of an error in the detection of the appropriate pressing distance R−n2 or in the detection of the paper thickness t and for this reason, it is preferable that the paper 4 be tensioned during the operation of the printing gap adjustment system. To impart tension to the paper 4, the paper detecting means 56 is preferably designed to release an instruction to the paper feed control means (not shown) to execute a paper tensioning process while outputting the adjustment start instruction signal $A_1$. In such a paper tensioning process, the upstream tractor 2 may be slightly, reversely rotated or the downstream tractor 3 may be slightly, forwardly rotated. It is also possible to perform the reverse rotation and the forward rotation at the same time.

Figure 14:
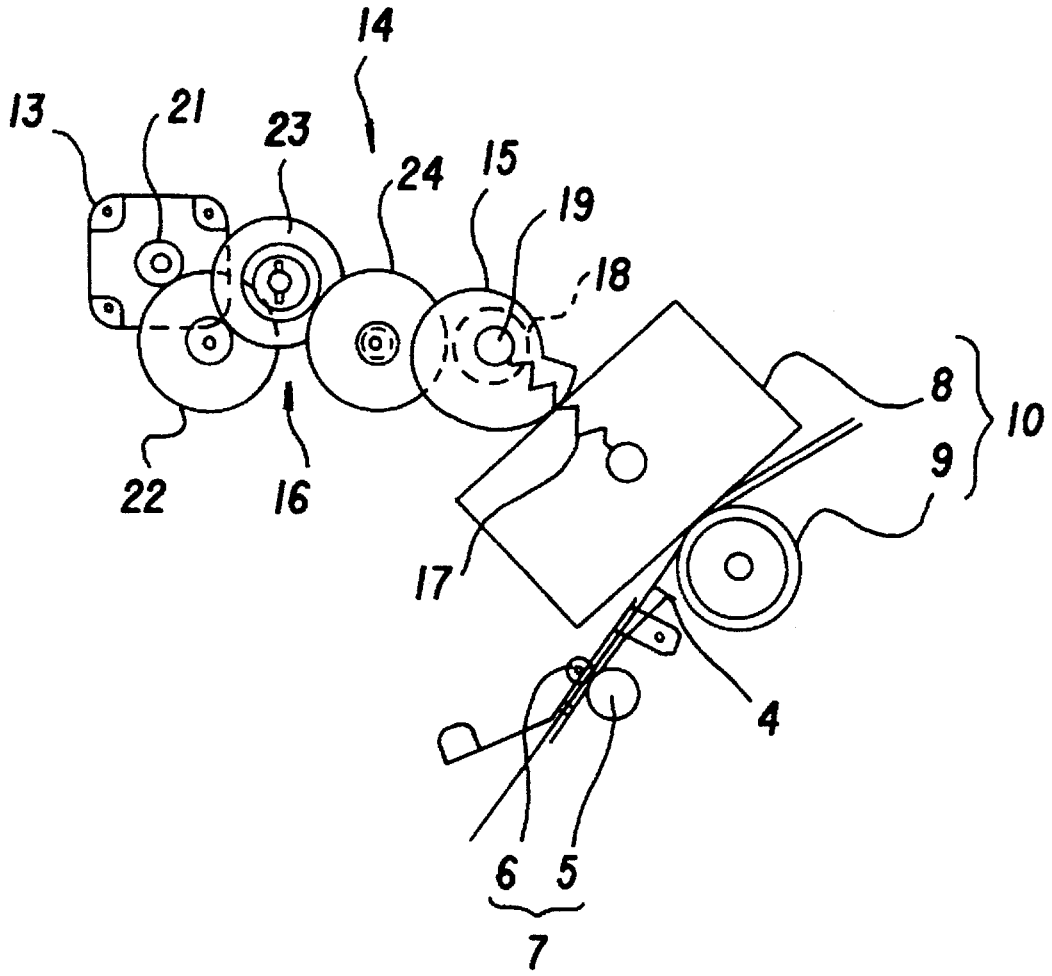
FIG. 14 is a side view showing an embodiment where a print head moves closer to or away from a platen.
Figure 15:
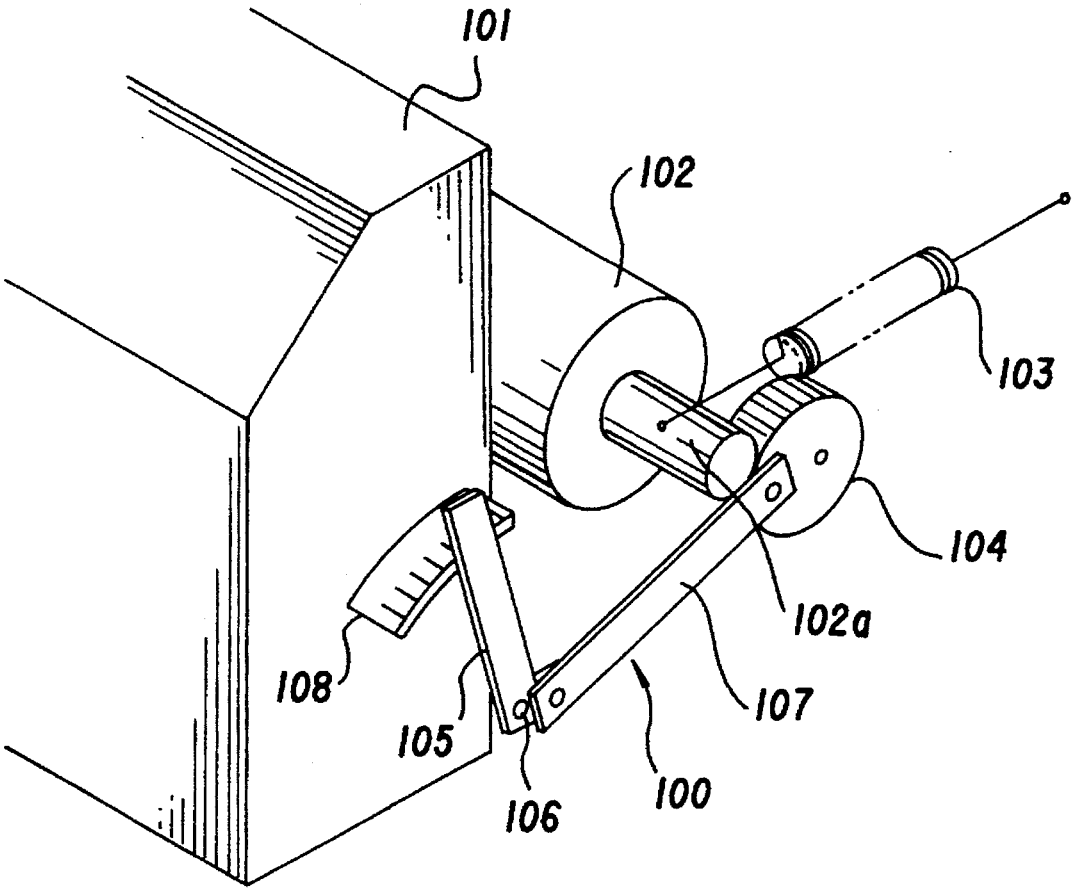
PRIOR ART FIG.15
FIG. 15 is a perspective view of a prior art printing gap adjustment system.

In the foregoing embodiments, the invention has been particularly described with the case the platen 9 is moved closer to or away from the print head 8. However, the invention is also applicable to the case the print head 8 is moved closer to or away from the platen 9 as shown in FIG. 14.

The invention being thus described, it will be obvious that the same may be varied in many ways. Such variations are not to be regarded as a departure frown the spirit and scope of the invention, and all such modifications as would be obvious to one skilled in the art are intended to be included within the scope of the following claims.

What is claimed is:

1. A printing gap adjustment system for adjusting the printing gap between a print head and a platen that are so disposed as to move closer to or away from each other with a paper sheet interposed therebetween, the system comprising:

(a) an approach/separation mechanism for moving either the platen or the print head closer to or away from the other so that the relative positions of the platen and the print head are adjusted;

(b) a torque limiter incorporated in the approach/separation mechanism, for cutting off a pressing force applied to the paper sheet by means of the print head and the platen when the pressing force exceeds a predetermined value; and (c) approach/separation control means for controlling the approach/separation mechanism such that either the print head or the platen is moved, from an initial position, closer to a pressing position where the paper sheet is to be pressed by the print head and the platen, and then moved to an origin position, being far away from the paper sheet, and then moved from the origin position, by an appropriate pressing distance obtained by subtracting an appropriate value for the printing gap from the distance between the pressing position and the origin position, in the direction in which the relative positions of the print head and the platen come closer.

2. The printing gap adjustment system as claimed in claim 1, further comprising an origin sensor for detecting the state that the print head or the platen which has moved from the pressing position reaches the origin position.

3. The printing gap adjustment system as claimed in claim 1, wherein the approach/separation control means comprises:

(a) initial movement control means for initially moving the print head or the platen from the initial position to the pressing position where the paper sheet is to be pressed by the print head and the platen;

(b) reverse movement control means for moving the print head or the platen to the origin position, being far away from the paper sheet and obtaining its moving distance, after the initial movement by the initial movement control means has been completed;

(c) computing means for calculating said appropriate pressing distance by subtracting said appropriate value for the printing gap from the distance between the pressing position and the origin position, said distance being obtained by the reverse movement control means; and (d) adjustment movement control means for moving the print head or the platen from the origin position by said appropriate pressing distance so that the relative positions of the print head and the platen come closer.

4. The printing gap adjustment system as claimed in claim 3, wherein the approach/separation control means performs control such that the print head or the platen is repeatedly reciprocated between the pressing position and the origin position a plurality of number of times and the distance between the pressing position and the origin position is detected a plurality of number of times, and wherein the computing means computes the average of a plurality of detection values of the distance between the pressing position and the origin position and obtains said appropriate pressing distance by subtracting said appropriate value for the printing gap from said average value.

5. The printing gap adjustment system as claimed in claim 3, further comprising paper width detecting means for detecting the width of the paper sheet on which images are to be printed, wherein the computing means corrects said appropriate pressing distance based on the width of the paper sheet detected by the paper width detecting means.

6. The printing gap adjustment system as claimed in claim 5, wherein the computing means corrects said appropriate pressing distance for a paper sheet having a small width so as to be shorter, compared to the appropriate pressing distance for a paper sheet having a normal width.

7. The printing gap adjustment system as claimed in claim 5, wherein the paper width detecting means detects the width of the paper sheet by detecting the gap between the right and left parts of at least one tractor which delivers the paper sheet, hooking in the feed holes formed on the paper sheet.

8. The printing gap adjustment system as claimed in claim 7, wherein either the right part or left part of the tractor or its supporting member is provided with an object to be detected, while the other part of the tractor or its supporting member is provided with a paper width detecting sensor and wherein the paper width detecting sensor detects the gap between the right and left parts of the tractor by detecting the object.

9. The printing gap adjustment system as claimed in claim 8, wherein said tractors are disposed upstream and downstream the print head along a paper delivery direction and wherein said supporting members are couplers for coupling said upstream tractor and said downstream tractor to each other.

10. The printing gap adjustment system as claimed in claim 8, wherein a plurality of paper width detecting sensors are provided and the width of the paper sheet is detected by the use of the plurality of the paper width detecting sensors at multiple positions.

11. The printing gap adjustment system as claimed in claim 5, further comprising abnormality detecting means for generating a printing stop instruction when the paper width detecting means detects a state that the width of the paper sheet on which images are to be printed is out of a specified range.

12. The printing gap adjustment system as claimed in claim 3, wherein the computing means includes the function to compute paper thickness based on the distance between the pressing position and the origin position and has printing density control means for controlling printing density in accordance with the paper thickness calculated by the computing means.

13. The printing gap adjustment system as claimed in claim 12, wherein the printing density control means is overprinting control means which prints the same image data on the same position of the paper sheet a fixed number of times which is predetermined according to the paper thickness.

14. The printing gap adjustment system as claimed in claim 12, wherein the printing density control means is drive current control means for controlling a drive current to be supplied to the print head according to the paper thickness.

15. The printing gap adjustment system as claimed in claim 12, wherein the printing density control means is printing speed control means which controls the printing speed of the print head and energizing time according to the paper thickness.

16. The printing gap adjustment system as claimed in claim 5, further comprising paper detecting means for detecting a state that the paper sheet on which images are to be printed is positioned between the print head and the platen prior to actuation of the approach/separation mechanism.

17. The printing gap adjustment system as claimed in claim 16, further comprising paper feed control means which slightly, reversely rotates an upstream tractor positioned upstream the print head along a paper delivery direction and/or slightly, forwardly rotates a downstream tractor positioned downstream the print head along the paper delivery direction, upon detection of the presence of the paper sheet by the paper detecting means.

18. The printing gap adjustment system as claimed in claim 5, further comprising restarting means for restarting actuation of the printing gap adjustment system when a preset condition is satisfied during printing operation.

19. The printing gap adjustment system as claimed in claim 18, wherein the preset condition is a detection of an elapse of printing time more than a certain value.

20. The printing gap adjustment system as claimed in claim 18, wherein the preset condition is a detection of a state that the number of continuous printing lines has reached a predetermined value.

21. The printing gap adjustment system as claimed in claim 18, wherein the preset condition is a detection of printing completion for paper sheets stored in one paper hopper.

22. The printing gap adjustment system as claimed in claim 18, wherein the preset condition is a detection of completion of one job.

23. The printing gap adjustment system as claimed in claim 18, wherein the preset condition is a detection of a change in the temperature of the platen more than a predetermined value.

24. The printing gap adjustment system as claimed in claim 1, further comprising power supply maintaining means for maintaining power supply for a predetermined time when a power switch for the printing unit is turned off and releasing means for separating the relative positions of the platen and the print head when the power supply maintaining means has detected a turn-off of the power switch.

* * * * *